US005649633A

United States Patent [19]

Bellerose

[11] Patent Number: 5,649,633

[45] Date of Patent: Jul. 22, 1997

[54] SKI RACK

[76] Inventor: Gerald Bellerose, 275B, Mgr. Gravel Street, Nicolet, QC, Canada, J3T 1A5

[21] Appl. No.: 260,179

[22] Filed: Jun. 15, 1994

[51] Int. Cl.[6] ..... A47F 7/00

[52] U.S. Cl. ..... 211/70.5; 211/60.1

[58] Field of Search ..... 211/70.5, 70, 60.1, 211/37

[56] References Cited

U.S. PATENT DOCUMENTS

| | | | |
|---|---|---|---|
| 1,586,826 | 6/1926 | Michelbach | 211/70 |
| 3,722,652 | 3/1973 | Busch et al. | 211/70.5 X |
| 3,826,378 | 7/1974 | Novak | 211/60 |
| 4,222,490 | 9/1980 | Wood, Jr. | 211/60 |
| 4,688,685 | 8/1987 | Brace | 211/70.5 |
| 4,732,283 | 3/1988 | Schmidt | 211/70.5 |
| 5,065,871 | 11/1991 | Chan | 211/37 |

FOREIGN PATENT DOCUMENTS

| | | | |
|---|---|---|---|
| 972726 | 7/1975 | Canada | 211/7 |
| 1231674 | 6/1988 | Canada | 211/7 |
| 1274217 | 11/1990 | Canada | 211/7 |

*Primary Examiner*—Korie Chan
*Attorney, Agent, or Firm*—Darby & Darby

[57] ABSTRACT

The ski rack is for supporting a pair of skis. Each pair of skis comprises a heel and an intermediary portion. The skis of a same pair of skis are fastened together with their sole applied one against the other. The ski rack comprises a base having a center, a member having a center, four masts for positioning the member substantially concentrically above the base, a recess provided in the base for receiving the heel of a pair of skis and a "L" shaped side of the member associated with the recess for receiving the intermediary portion of the pair of skis. The improvement to this ski rack is that each recess is positioned with respect to its corresponding "L" shaped side so that in operation the center of gravity of the pair of skis is above a vertical projection of the base and above the member.

15 Claims, 6 Drawing Sheets

SKI RACK

FIELD OF THE INVENTION

The present invention relates to a ski rack for storing pairs of skis in a minimal volume. Furthermore, the rack itself is compact and can be stored easily.

BACKGROUND OF THE INVENTION

Indoor and outdoor ski racks for storing skis are known in the art. Up to now, skis were either stored in pairs or individually. Racks for storing skis in pairs are either large and/or cumbersome or are unstable. Such racks are disclosed in U.S. Pat. Nos. 3,826,378, 4,222,490 and 4,732,283. A drawback with such racks is that pairs of skis are stored substantially vertically therein so that a substantial storage volume is required. Racks for individually storing skis are smaller than the ones for storing skis in pairs, but more storage volume is needed than when the skis are stored by pairs. Such racks are disclosed in U.S. Pat. No. 4,688,685 and Canadian Patent No. 1,231,674.

Furthermore, ski racks of prior art provide space for further storing ski boots or ski poles only by reducing the space already provided for skis.

It is an object of the present invention to provide a ski rack for storing pairs of skis that, when there is no ski in the rack, the ski rack can be put away within a minimal volume.

Also, there is a very strong need for a ski rack for storing pairs of skis within a minimal volume and further providing enough space for storing ski poles and ski boots.

SUMMARY OF THE INVENTION

The present invention relates to a ski rack for storing pairs of skis within a minimal volume and further providing space for storing ski poles and ski boots.

The present invention also provides a ski rack that is long lasting, reliable and stable even if it is not fastened to the floor.

The present invention further provides a ski rack that is cheap and easy to manufacture.

The ski rack is for supporting a pair of skis. Each pair of skis comprises a heel and an intermediary portion. The skis of a same pair of skis are fastened together with their soles applied one against the other. The ski rack comprises a base having a centre, a member having a centre, four masts for positioning the member substantially concentrically above the base,a recess provided in the base for receiving the heel of a pair of skis and a "L" shaped side of the member associated with the recess for receiving the intermediary portion of the pair of skis. The improvement to this ski rack is characterised in that each recess is positioned with respect to its corresponding "L" shaped side so that in operation the centre of gravity of the pair of skis is above a vertical projection of the base and above the member.

BREIF DESCRIPTION OF THE DRAWINGS

The present invention will be better understood in the following description of preferred embodiments thereof made with reference to the following drawings in which.

DESCRIPTION OF PREFERRED EMBODIMENTS OF THE INVENTION

Figure 1:
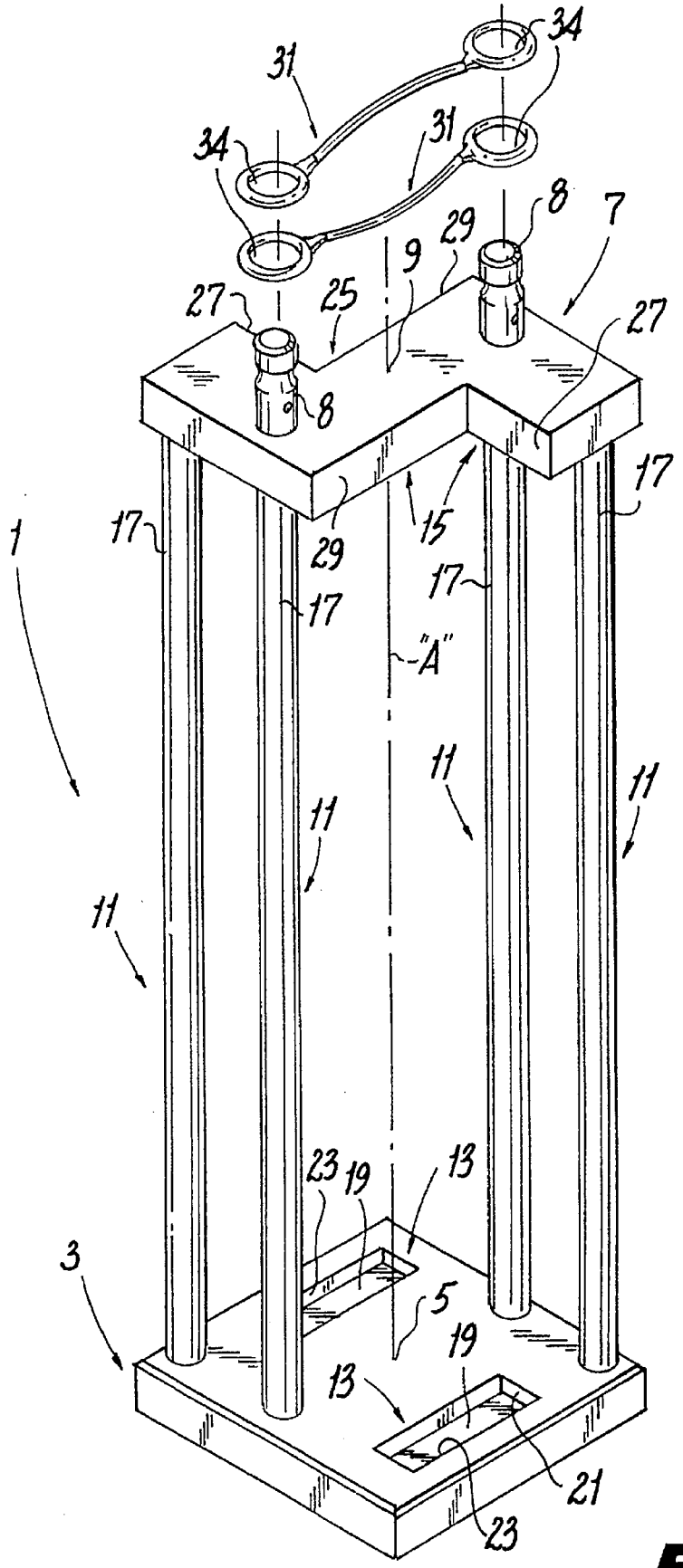
FIG. 1 is a perspective view of an embodiment of a ski rack according to the invention.
Figure 2:
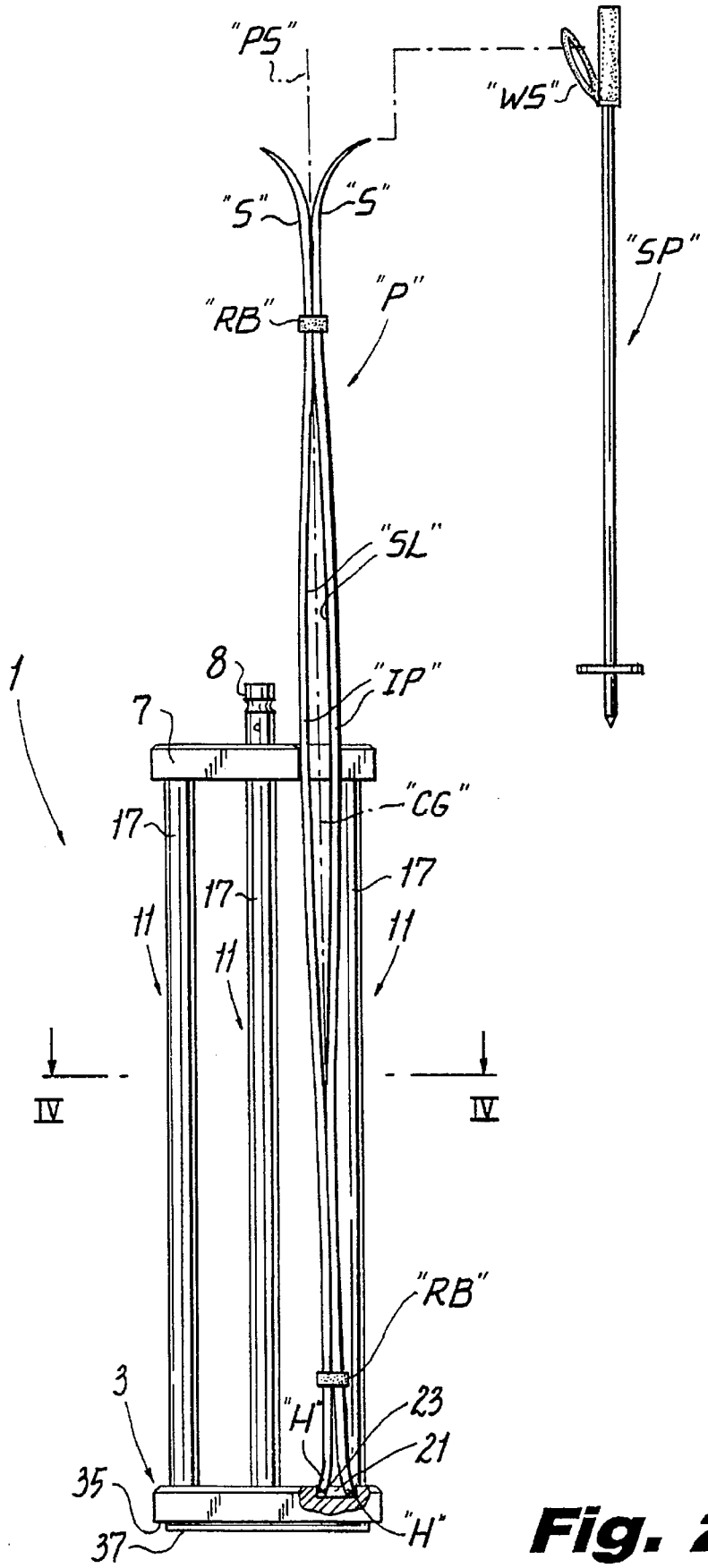
FIG. 2 is a side elevation view of the ski rack of FIG. 1.
Figure 3:
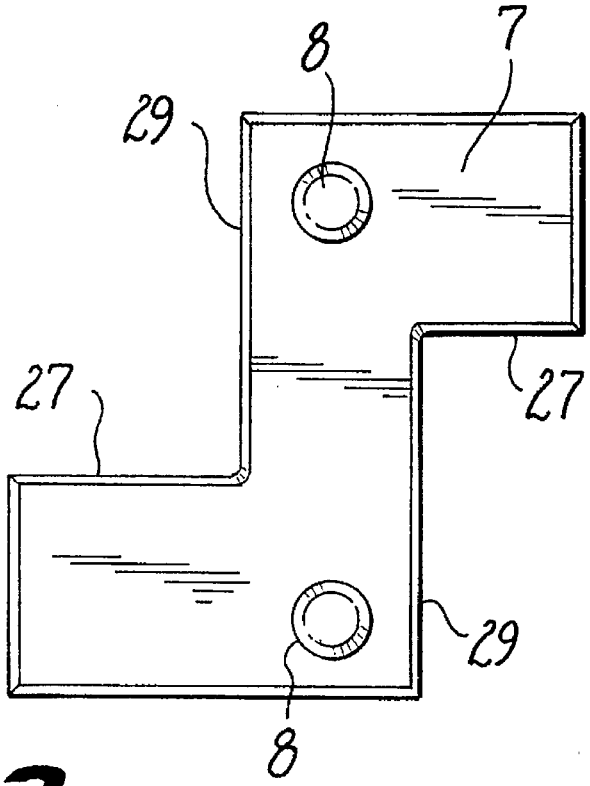
FIG. 3 is a top plan view of the ski rack of FIG. 1.
Figure 4:
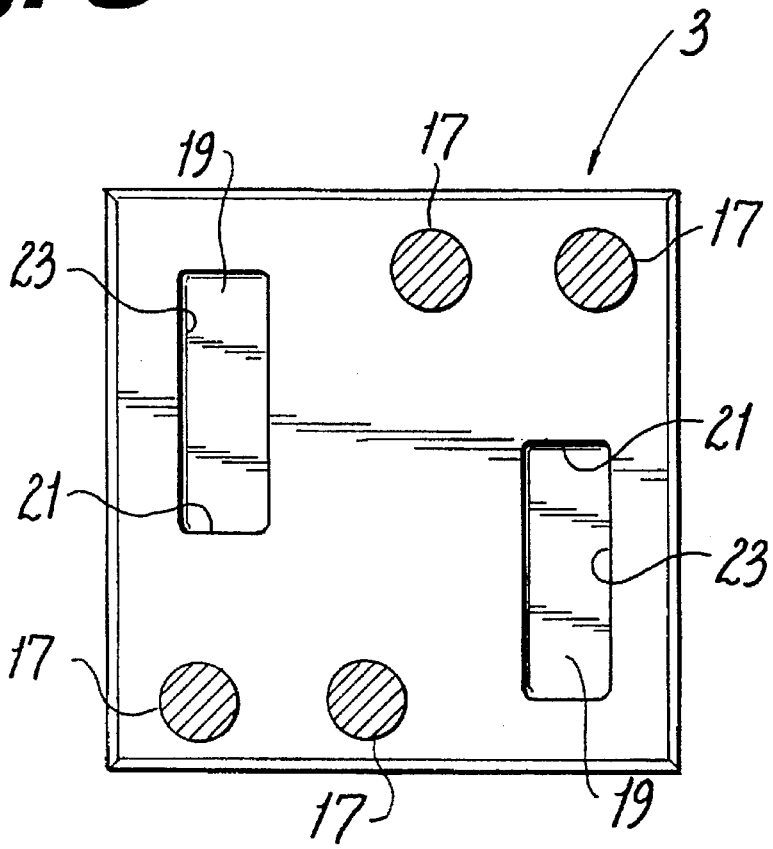
FIG. 4 is a sectional view along line IV—IV of the ski rack of FIG. 2 wherein the skis are not shown.

Referring to FIG. 1 to 4 of the drawings, there is shown a first preferred embodiment of the invention. More particularly, there is shown a ski rack 1 for storing pairs of skis "P" each comprising two skis "S" Each ski "S" has a heel "H", an intermediary portion "IP" and a sole "SL". Skis "S" of the pair of skis "P" are fastened together with their soles "SL" applied one against the other by any appropriate means well known in the art such as for example rubber bands "RB".

The ski rack 1 illustrated in FIGS. 1 to 4 comprises a base 3 having a centre 5; a member 7 having a centre 9; elongated members 11 for positioning the member 7 substantially concentrically above the base 3; recesses 19 each for receiving the heel "H" of at least one ski "S" of the pair of skis "P", the recesses 19 being provided in the base 3; and "L" shaped sides 25 provided on the member 7 each for receiving the intermediary portion "IP" of one ski "S" of the pair of skis "P".

The improvement in the ski rack 1 is that for each pair of skis "P", each of the recesses 19 and the corresponding "L" shaped sides 25 are positioned to set the centre of gravity "CG" of the pair of skis "P" above a portion of the base 3 and to set the plane of symmetry "PS" extending between each ski "S" of the same pair of skis "P", slightly inclined with respect to an axis "A" passing through the centre 5 of the base 3 and the centre 9 of the member 7.

Advantageously, the elongated members 11 comprise at least one mast having opposite ends, and preferably comprise, as illustrated, four masts 17 having opposite ends. Each mast 17 has one of its ends that is integral with the base 3 while its opposite end is integral with the member 7.

According to a particularly preferred embodiment of the invention illustrated in FIGS. 1 to 4, the base 3 consists of a piece of material having a given thickness, the member 7 consists of a piece of material having a given thickness and the mast 17 consists of four rods having opposite ends fastened by any appropriate means to the base 3 and the member 7. For example, the base 3, the member 7 and the rods 17 are made of wood, plastics, etc. Assembly of the rods 17 to the base 3 and the member 7, is achieved, for example, by providing bores in the top of the base and underneath the member 7 for receiving corresponding ends of said rods.

Advantageously, for each pair of skis "P", each recess 19 which is substantially rectangular comprises a pair of substantially orthogonal positioning edges 21, 23. Each "L" shaped side 25 comprises a pair of substantially orthogonal positioning edges 27, 29. The positioning edges 21 and 27 are contained in a common substantially vertical plane.

Advantageously, as illustrated in FIG. 1 to 4, two substantially rectangular recesses 19 are provided in the base 3. Two substantially "L" shaped sides 25 are provided in the member 7 for receiving two pairs of skis "P". Preferably, the recesses 19 and the "L" shaped sides 25 are respectively uniformly distributed in the base 3 and the member 7.

Advantageously, locking means 31 are provided to lock each pair of skis "P" in position in their corresponding recess 19 and "L" shaped side 25. According to a particularly preferred embodiment of the invention, the locking means 31 comprises a cord 33 having opposite ends. One of the ends is removably fastened to the protuberance 8 which is near the positioning edge 29 of one of the "L" shaped sides 25 and the opposite end of the cord 33 is either integral or removably fastened to the protuberance 8 which is near the other positioning edge 27 of said one substantially "L" shaped side 25. Preferably, each cord 33 is provided with loops 34 for engagement with protuberances 8 provided on the member 7.

Advantageously, the base 3 has an underneath 35 that is associated with pivoting means. Preferably, the base 3 is provided with fastening means (e.g. nails, screws, etc.) to fasten it to the floor.

To use a ski rack 1 according to the invention, one only has to unfasten the cord 33 from the protuberance 8 which is near the positioning edge 27, put the heels "H" of the skis of the pair of skis "P" in the recess 19, apply the heels of the skis against positioning edges 21, 23, tilt the pair of skis "P" until the intermediary portion "IP" is applied against the positioning edges 27, 29. Then the cord 33 is fastened back on the protuberance 8 which is near the positioning edge 27. Optionally, the ski pole "SP" is hooked on the tip of one ski "S" of the pair by passing the wrist-strap "WS" around it. To remove the pair of skis from the ski rack 1, one only has to carry out the above steps in reverse order.

Figure 5:
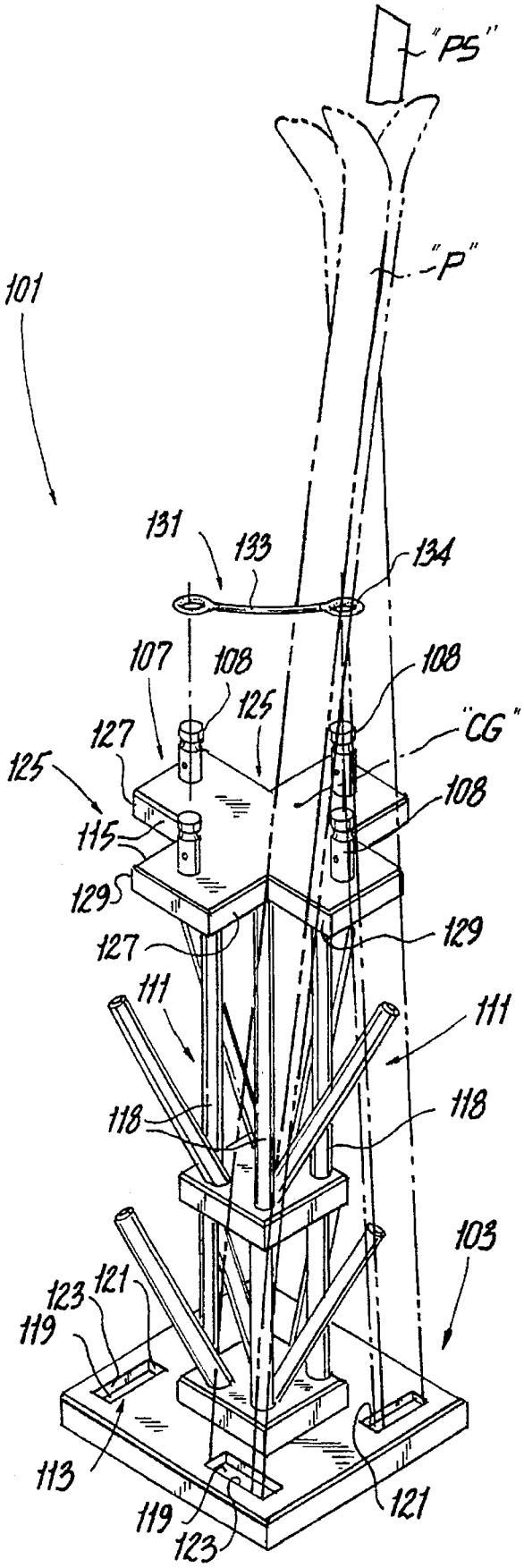
FIG. 5 is a perspective view of another ski rack according to the invention.
Figure 6:
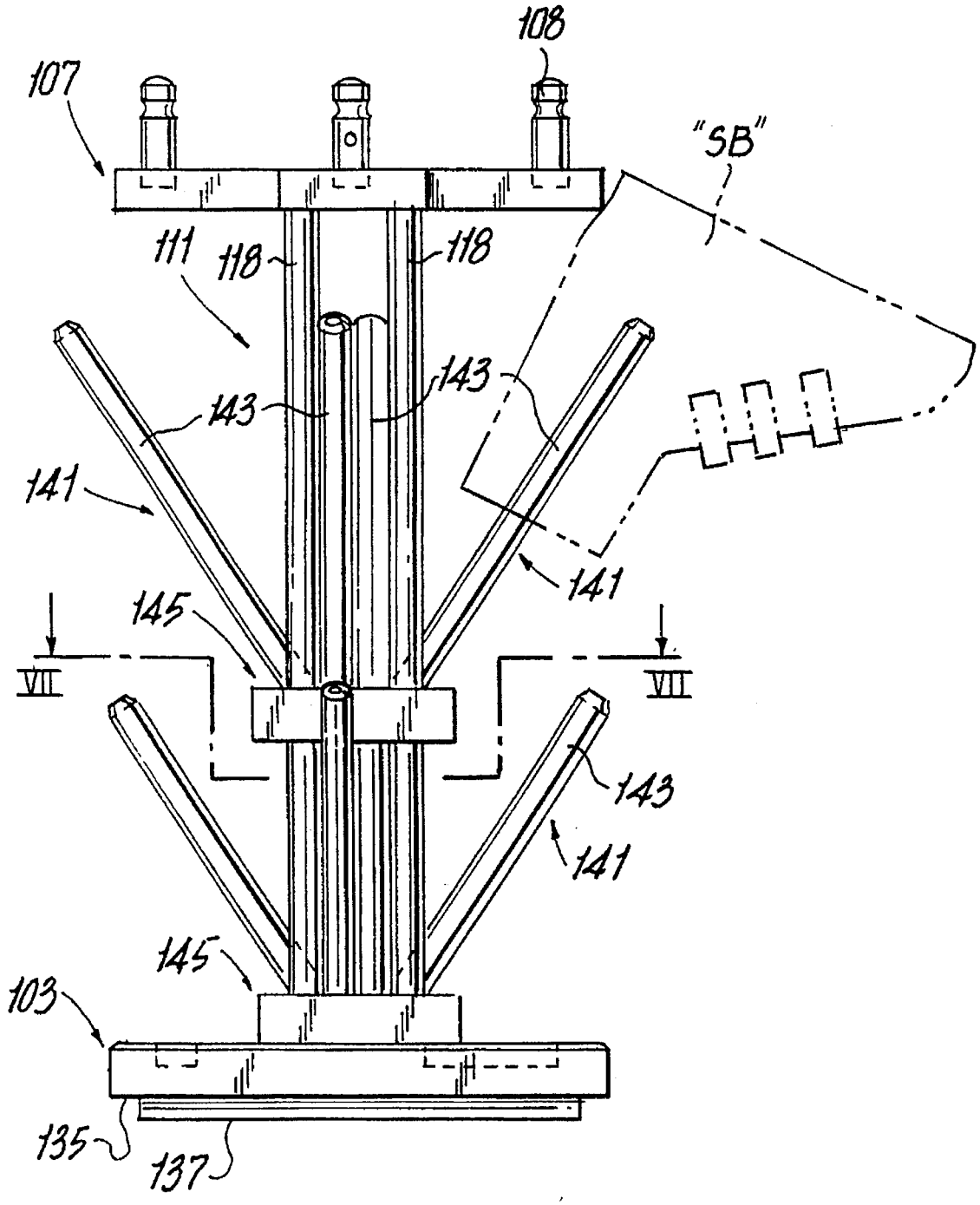
FIG. 6 is a side elevation view of the ski rack of FIG. 5.
Figure 7:
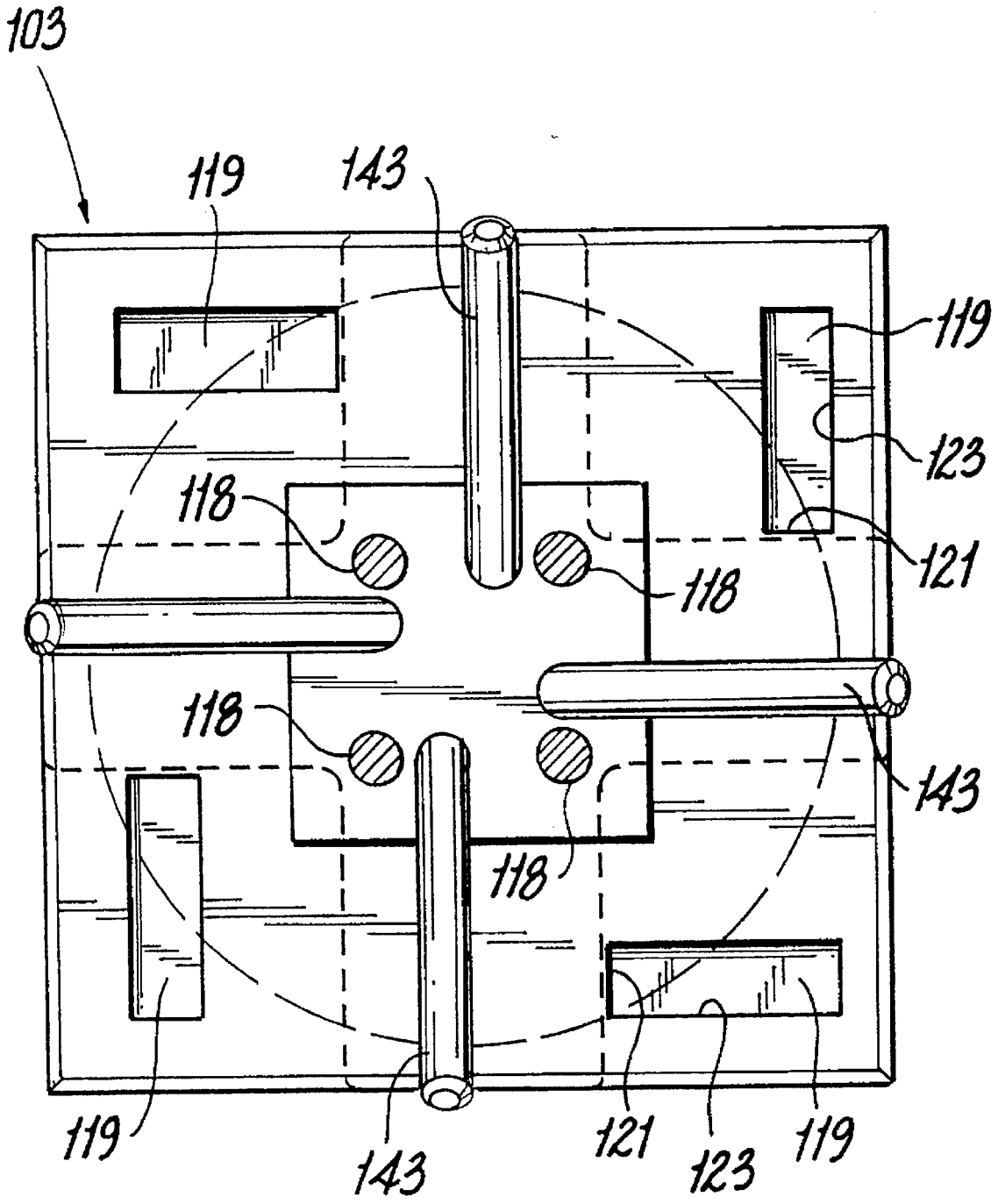
FIG. 7 is a sectional view along line VII—VII of the ski rack of FIG. 6.

A particularly preferred embodiment of the invention is illustrated in FIGS. 5 TO 7 of the drawings. More particularly, there is illustrated in these Figures a ski rack 101 for pair of skis "P" similar to the one previously described.

The ski rack 101 illustrated in FIGS. 5 to 7 comprises a base 103 having a centre; a member 107 having a centre; at least one mast 111 for positioning the member 107 substantially concentrically above the base 103; recesses 119 each for receiving the heel "H" of at least one ski "S" of the pair of skis "P", the recesses 119 being provided in the base 103; and "L" shaped sides 125 provided on the member 107 for receiving an intermediary portion "IP" of one ski "S" of the pair of skis "P".

The improvement in the ski rack 101 is that for each pair of skis "P", each recess 119 and the corresponding "L" shaped sides 115 are positioned to set the centre of gravity "CG" of the pair of skis "P" above a portion of the base 103 and above the member 107, and to set the plane of symmetry "PS" extending between each ski "S" of the pair of skis "P", slightly inclined with respect to the axis "A'" passing through the centre 105 of the base 103 and the centre 109 of the member 107.

Advantageously, the at least one mast 111 has opposite ends, and consists of four stud members 118 having opposite ends. Each of stud members 118 has one of its ends that is integral with the base 103 while its opposite end is integral with the member 107. Advantageously each stud member 118 is as illustrated in FIGS. 5 to 7.

Advantageously, each recess 119 which is substantially rectangular, as illustrated in FIGS. 5 to 7, comprises at least one pair of substantially orthogonal positioning edges 121, 123. Each "L" shaped side 125 comprises one pair of substantially orthogonal positioning edges 127, 129 which are, as illustrated in FIGS. 5 to 7. The positioning edge 121 of the recess 119 and the positioning edge 127 of a corresponding "L" shaped side 125 are contained in a common substantially vertical plane.

Advantageously, as illustrated, four substantially rectangular recesses 119 are provided in the base 103. Four corresponding substantially "L" shaped sides 125 are provided in the member 107 for receiving four pairs of skis "P". Preferably, the recesses 119 and "L" shaped sides 125 are respectively uniformly distributed in the base 103 and the member 107.

Advantageously, locking means 131 (only one is illustrated) are provided to lock each pair of skis "P" in position in their corresponding "L" shaped sides 125. According to a particularly preferred embodiment of the invention, for each substantially "L" shaped side 125, the locking means 131 comprises a cord 133 having opposite ends. One of the ends is removably fastened to the protuberance 108 near the positioning edge 127 and the opposite end of the cord 133 is either integral or removably fastened to the protuberance 108 near the positioning edge 129. Preferably, each end of the cord 133 is provided with a loop 134 for engagement with a protuberance 108. This cord presses the intermediary portion "IP" of the pair of skis against positioning edges 127 and 129. Alternatively, each end of the cord may be provided with a knot or preferably one of the ends may be further provided with a knob, and protuberances 108 are replaced by a bore and a slot. The cord is passed through said bore. The bore may appear in the "L" shaped side 125 and have a diameter smaller than the size of the knot provided at one end of the cord. The slot may appear in the positioning edge 127 and have an opening that is not oriented toward the bore of the same "L" shaped side 125. The width of this slot is sufficient to receive the cord therein and smaller than the size of the knot or knob provided at the opposite end of the cord.

Advantageously, the base 103 has an underneath 135 that is associated with pivoting means 137. The pivoting means is of any kind well known in the art. For example, it includes a stationary base provided with a central pivot supporting the centre of the underneath of the base 103, or small wheels mounted on the underneath surface of the base 103. Preferably, the base 103 is provided with fastening means (e.g. nails, screws, etc.) to fasten it to the floor.

Advantageously, hooking means 141 are further provided for hooking ski boots "SB" on the ski rack 101. As illustrated, the hooking means 141 comprise a plurality of pegs 143 having opposite ends. One end of each peg 143 is integral with the corresponding member 145 which is integral with the mast and/or the base 103. Preferably, as illustrated, there are two members 145 where pegs 143 are fastened by any appropriate means well known in the art (e.g. by the introduction of one end of each peg 143 in a corresponding bore provided in the member 145). Each peg 143 is inclined in order to have its free end oriented upwardly for receiving the inside of a ski boot "SB". The pegs 143 are uniformly distributed in two rows. The pegs 143 are distributed in such a way that they do not interfere with the recesses 119 and "L" shaped sides 125.

To use a ski rack 101 according to the invention, one only has to unfasten one end of the cord 133 from the protuberance 108 which is near the positioning edge 127, put the heels "H" of the skis of the pair of skis "P" in the corresponding substantially rectangular recess 119, apply the heels of the skis against positioning edges 121, 123, and tilt the pair of skis "P" until the intermediary portion "IP" is applied against the positioning edges 127, 129. Then the end of the cord 133 is fastened back on the protuberance 108 which is near the positioning edge 127. Optionally, the ski pole "SP" is hooked on the tip of one ski "S" of the pair by passing the wrist-strap around it (in the same way than it was done in FIG. 2). To remove the pair of ski from the ski rack 1, one only has to carry out the above steps in reverse order.

The invention also relates to any variation that may appear obvious to a man skilled in the art. For example, if the ski rack is made of several pieces to be assembled together, this is also an obvious variation of the invention. Of course, the ski racks according to the invention may be made by any appropriate technique well known in the art. Techniques for manufacturing the ski racks of the invention are not part of the invention and therefore do not need to be explained in detail.

What is claimed is:

1. A ski rack for supporting multiple pairs of skis with the skis of each pair in sole-to-sole contacting relation, each pair of skis comprising a heel having narrow and large sides and an intermediary portion having narrow and large sides, each of the multiple pairs of skis having a center of gravity, the ski rack comprising:

a base having a center and provided with multiple first receiving means each for receiving the heel of one of the pairs of skis, each of the first receiving means having first and second positioning edges, the first positioning edge being for receiving the narrow side of the corresponding heel, the second positioning edge being for receiving the large side of the corresponding heel;

a member having a center and provided with multiple second receiving means each for receiving the intermediary portion of one of the pairs of skis, each of the second receiving means having first and second positioning edges, the first positioning edge of the second receiving means being for receiving the narrow side of the corresponding intermediary portion, the second positioning edge of the second receiving means being for receiving the large side of the corresponding intermediary portion, the first receiving means are respectively associated with the second receiving means to form pairs of first and second receiving means, each of the pairs of first and second receiving means being for supporting one pair of skis;

positioning means for positioning the member substantially concentrically above the base; and for each of the pairs of first and second receiving means, the first positioning edge of the first receiving means and the first positioning edge of the second positioning means are in a common substantially vertical plane whereas the second positioning edge of the second receiving means is above, parallel to and horizontally offset with the second positioning edge of the first receiving means so that when one of the pairs of skis is supported in one of the pairs of first and second receiving means said one pair of skis is slightly inclined with respect to a vertical plane and its center of gravity is located above a vertical projection of the base and above the member.

2. The ski rack according to claim 1, wherein the positioning means comprise at least one mast having opposite ends, one end of said ends being integral with the base while the opposite end is integral with the member.

3. The ski rack according to claim 2, wherein at least four masts are provided.

4. The ski rack according to claim 2, wherein for each pair of skis, the first and the second positioning edges of the first receiving means form a pair of substantially orthogonal positioning edges; and wherein for each pair of skis, the first and the second positioning edges of the second receiving means form a pair of substantially orthogonal positioning edges.

5. The ski rack according to claim 4, wherein each pair of substantially orthogonal positioning edges of the first receiving means are defined by orthogonal edges of a substantially rectangular recess provided in the base, wherein each pair of substantially orthogonal positioning edges of the second receiving means are defined by orthogonal edges of a substantially "L" shaped side provided in the member, and wherein two substantially rectangular recesses are provided in the base and two substantially "L" shaped sides are provided in the member for receiving two pairs of skis, said recesses and said "L" shaped sides being respectively uniformly distributed in the base and the first member.

6. The ski rack according to claim 5, wherein locking means are further provided to lock each pair of skis in their corresponding "L" shaped sides.

7. The ski rack according to claim 6, wherein said locking means comprise a cord having opposite ends, one of said ends being removably fastened to one of said positioning edges of the "L" shaped side and the opposite end being either integral or removably fastened to the other positioning edge of the "L" shaped side.

8. The ski rack according to claim 1, wherein the positioning means comprise a mast having opposite ends, one end of said ends being an integral part of the centre of the base while the opposite end is an integral part of the centre of the member.

9. The ski rack according to claim 8, wherein for each pair of skis, the first and the second positioning edges of the first receiving means form a pair of substantially orthogonal positioning edges; and wherein for each pair of skis, the first and the second positioning edges of the second receiving means form a pair of substantially orthogonal positioning edges.

10. The ski rack according to claim 9, wherein each pair of substantially orthogonal positioning edges of the first receiving means are defined by orthogonal edges of a substantially rectangular recess provided in the base, wherein each pair of substantially orthogonal positioning edges of the second receiving means are defined by orthogonal edges of a substantially "L" shaped side provided in the member, and wherein four substantially rectangular recesses are provided in the base and four "L" shaped sides are provided in the member for receiving four pairs of skis, said recesses and said "L" shaped sides being respectively uniformly distributed in the base and the first member.

11. The ski rack according to claim 10, wherein locking means are further provided to lock each pair of skis in their corresponding "L" shaped sides.

12. The ski rack according to claim 11, wherein said locking means comprise a cord having opposite ends, one of said ends being removably fastened to one of said positioning edges of the "L" shaped side and the opposite end being either integral or removably fastened to the other positioning edge of the "L" shaped side.

13. The ski rack according to claim 8, wherein hooking means are further provided for hooking ski boots on the rack.

14. The ski rack according to claim 13, wherein said hooking means comprise a plurality of pegs having opposite ends, each peg having opposite ends, one end of said ends being integral with the ski rack, each peg being inclined to have their free end oriented upwardly for receiving the inside of a ski boot and said pegs being uniformly distributed in two rows around the mast not interfering with the first and second receiving means.

15. The ski rack according to claim 8, wherein said base has an underneath provided with pivoting means.

* * * * *